US012344432B2

(12) United States Patent
Raymus

(10) Patent No.: US 12,344,432 B2
(45) Date of Patent: Jul. 1, 2025

(54) FUNNEL CONTAINER FOR USE WITH A BEVERAGE BOTTLE

(71) Applicant: Thomas Anthony Raymus, Manteca, CA (US)

(72) Inventor: Thomas Anthony Raymus, Manteca, CA (US)

( * ) Notice: Subject to any disclaimer, the term of this patent is extended or adjusted under 35 U.S.C. 154(b) by 9 days.

(21) Appl. No.: 18/431,551

(22) Filed: Feb. 2, 2024

(65) Prior Publication Data

US 2024/0182201 A1 Jun. 6, 2024

Related U.S. Application Data

(63) Continuation-in-part of application No. 18/399,631, filed on Dec. 28, 2023, and a continuation-in-part of application No. 17/939,715, filed on Sep. 7, 2022, now Pat. No. 11,912,555.

(60) Provisional application No. 63/538,947, filed on Sep. 18, 2023.

(51) Int. Cl.
*B65D 1/06* (2006.01)
*B65D 21/02* (2006.01)

(52) U.S. Cl.
CPC ..... *B65D 1/06* (2013.01); *B65D 21/0219* (2013.01)

(58) Field of Classification Search
CPC . B67C 11/02; B67C 2011/20; B65D 21/0233; B65D 21/0219; B65D 1/06
See application file for complete search history.

(56) References Cited

U.S. PATENT DOCUMENTS 5,033,521 A * 7/1991 Martin ..... B67C 11/02 141/86
8,763,849 B2 * 7/2014 Benetti ..... A47G 19/2255 220/604
9,216,843 B2 * 12/2015 Sorensen ..... B65D 81/3205
2014/0332495 A1 * 11/2014 Choi ..... B65D 1/06 215/378

FOREIGN PATENT DOCUMENTS

DE 3921971 A * 1/1991 ..... B65D 1/06

* cited by examiner

*Primary Examiner* — Timothy L Maust
(74) *Attorney, Agent, or Firm* — Boris Leschinsky

(57) ABSTRACT

A funnel container for storing powdered supplements for use with a beverage bottle has a generally funnel-shaped body extending from a top opening to a smaller bottom opening having a twist-lock nozzle. A removable top cover to sealingly close off the top opening has one or more twist-lock receptacles, configured to cooperate with the twist-lock nozzle of the funnel-shaped body. A removable elastic bottom plug is configured to sealingly fit inside and close off a twist-lock nozzle. The twist-lock receptacle and the twist-lock nozzle are configured to fit together so as to facilitate the attachment of the twist-lock nozzle (with the bottom plug within thereof) to the twist-lock receptacle. This arrangement is useful for using the top cover as a stand to position the funnel container on a flat surface in a stable manner when filling the container with powder. It is also useful for stacking two or more containers together while the content of each container is securely sealed within each respective funnel container.

16 Claims, 19 Drawing Sheets

FUNNEL CONTAINER FOR USE WITH A BEVERAGE BOTTLE

This patent application claims a priority date benefit from the U.S. Provisional Patent Application No. 63/538,947 filed by the same inventor on 18 Sep. 2023 and entitled "Stackable funnel container for use with a beverage bottle."

This patent application is a continuation-in-part and claims a priority date benefit from a co-pending U.S. patent application Ser. No. 17/939,715, filed 7 Sep. 2022 by the same inventor and entitled "Mixing container configured for funneled engagement with drink containers."

This patent application is also a continuation-in-part and claims a priority date benefit from a co-pending U.S. patent application Ser. No. 18/399,631, filed 28 Dec. 2023 and entitled "A liquid container with a universal adapter and accessories therefor," which in turn claims a priority date benefit from the following provisional patent applications by the same inventor:

a. U.S. Provisional Patent Application No. 63/465,588 filed 11 May 2023 entitled "Modular container accessory system"
b. U.S. Provisional Patent Application No. 63/468,972 filed 25 May 2023, also entitled "Modular container accessory system"
c. U.S. Provisional Patent Application No. 63/532,186 filed 11 Aug. 2023 entitled "Smartphone holder and stand accessory for use with a water bottle"
d. U.S. Provisional Patent Application No. 63/538,947 filed 18 Sep. 2023 entitled "Stackable funnel container for use with a beverage bottle," and
e. U.S. Provisional Patent Application No. 63/543,323 filed 10 Oct. 2023 entitled "Water bottle handle with a smartphone stand."

All of the above-referenced patent documents are incorporated herein by reference in their respective entireties.

BACKGROUND

Without limiting the scope of the invention, its background is described in connection with portable containers that hold food supplements, vitamins, and the like. More particularly, the invention relates to mixing containers configured to function as portable, reusable enclosures to carry powder supplements, as well as to act as a funnel for depositing the container contents into a beverage bottle for mixing into the fluid therein.

Portable containers for food and supplements are widely sold and employed by users to hold food supplements, vitamins, or other edible contents. Such containers may be formed using food-grade polymeric materials, which renders them lightweight yet sufficiently sturdy such that they hold their shape and resist puncture or damage during transport, such as by a user in a backpack.

The use of powder or granules supplements dissolved in water after exercise is a common practice among fitness enthusiasts and athletes to aid in post-workout recovery and replenish nutrients lost during physical activity. These powdered supplements typically come in the form of protein powders, electrolyte drinks, amino acids, or various other nutritional additives. The primary purpose of consuming these supplements post-exercise is to facilitate muscle recovery, reduce muscle soreness, and rehydrate the body.

Protein powder is perhaps the most popular form of powdered supplement used after exercise. It provides the body with a concentrated source of protein, which is crucial for muscle repair and growth. Athletes and fitness enthusiasts often mix a scoop of protein powder with water, creating a convenient and quick way to ingest essential amino acids necessary for rebuilding muscle tissue. This helps expedite the recovery process, ensuring that the muscles are adequately nourished and repaired after a strenuous workout.

Electrolyte drinks in powder form are also widely used to replace the electrolytes lost through sweat during exercise. These supplements contain minerals like sodium, potassium, calcium, and magnesium, which help maintain proper fluid balance in the body. Dissolving an electrolyte powder in water provides a convenient means of rehydrating while replenishing these crucial electrolytes, preventing dehydration and muscle cramps, especially after intense physical activity in hot conditions.

Amino acid supplements in powder form are used to support muscle recovery and reduce muscle soreness. Branched-chain amino acids (BCAAs) are particularly popular in this regard. They can be dissolved in water and consumed after a workout to help reduce muscle protein breakdown and promote protein synthesis, ultimately aiding in the rebuilding of damaged muscle fibers.

Containers used for these powdered supplements vary in size and design but generally prioritize convenience and portability. Common options include plastic jars, resealable bags, and single-serving sachets. Plastic jars often house larger quantities of powdered supplements and come with a scoop for easy portioning. Resealable bags are convenient for those who prefer to buy supplements in bulk and dispense them into smaller containers as needed. Single-serving sachets are perfect for on-the-go individuals, as they can be easily carried in gym bags or pockets, providing a pre-measured amount of powder that can be mixed with water or a beverage of choice immediately after exercise.

Broadly speaking, dry supplements may be in the form of powders, dissolvable tablets, granules, caps, etc. More than one supplement may be included in a health regimen by a user, necessitating the use of multiple individual containers, making it less convenient to carry around along with a water bottle, for example, when attending a gym.

Various supplement containers are designed to be used in conjunction with water bottles, providing a convenient way to carry and mix powdered supplements with water. These containers are popular among athletes, fitness enthusiasts, and those on the go who want to stay hydrated and meet their nutritional needs. Here are some common types of supplement containers used with water bottles:

Shaker Bottle: Shaker bottles are specifically designed for mixing powdered supplements with water or other liquids. They typically consist of a plastic bottle with a screw-on lid and a mixing ball or mesh insert. The mixing ball helps break up clumps and ensures a smooth consistency when shaking the bottle. Users can add their supplement powder, pour in water, and then shake the bottle to blend the ingredients effectively.

Scoop Containers: These containers are small, portable jars or containers that hold pre-measured portions of supplement powder. They are designed to fit conveniently in the mouth or opening of a water bottle, allowing users to pour the contents directly into the bottle without the need for additional measuring tools. Scoop containers are particularly handy for those who prefer to pre-portion their supplements for the day.

Twist-and-Lock Caps: Some water bottles come with twist-and-lock caps that have a separate compartment at the bottom. Users can unscrew the bottom compartment, fill it with their supplement powder, and then reattach it to the bottle. When it's time to use the supplement, they can release the powder into the water bottle by twisting the bottom compartment open. This design keeps the powder separate from the liquid until it's time to mix.

Snap-On Caps: These caps have a snap-on or flip-top design and a separate compartment within the cap. Users can load their powdered supplement into the cap's compartment, snap it shut, and then attach the cap to their water bottle. When ready to use, they can release the supplement into the bottle by opening the cap's compartment.

Combo Bottles: Some water bottles are designed with a built-in compartment for storing supplements. This compartment is usually located in either the bottom or the cap of the bottle. Users can add their supplement powder to the compartment, and when they're ready to consume it, they can release the powder into the main bottle by twisting or opening the compartment.

Silicone Funnel Caps: These caps have a built-in funnel made of silicone that fits inside the neck of the water bottle. Users can pour their supplement powder into the funnel, and it directs the powder smoothly into the bottle without spillage or mess. It's a practical option for those who don't want to carry separate containers.

Clip-On Containers: These small containers can be clipped onto the side or handle of a water bottle. They are typically used to store supplement pills or capsules rather than powdered supplements. This allows users to have their pills readily accessible while staying hydrated.

Despite a great variety of available options, an optimal balance of portability and ease of use has not been reached yet. There is still a need for an improved system of one or more containers for carrying individual supplements along with a single beverage bottle used to dissolve the supplements therein.

SUMMARY

Accordingly, it is an object of the present invention to overcome these and other drawbacks of the prior art by providing a novel supplement container for use with a beverage bottle that is portable and convenient to carry powdered supplements prior to use.

It is another object of the present invention to provide a novel container for storing powdered supplements and configured for easy pouring of the content into a beverage bottle.

It is a further object of the present invention to provide a novel funnel container configured for stable positioning on a flat surface for the purposes of filling thereof with the desired powder content.

It is yet a further object of the present invention to provide a novel funnel container configured for easy attachment to a beverage bottle, either alone or stacked and/or mixed with other accessories used in conjunction with a reusable beverage bottle.

The novel funnel container of the present invention may be made to have a generally funnel-shaped body extending from a top opening to a bottom opening. The bottom opening may be smaller than the top opening. In some embodiments, the funnel container and its corresponding elements may have a circular shape. The funnel container may be supplied with a removable top cover configured to sealingly close off the top opening. The top cover may feature one or more twist-lock receptacles, which may be formed within the top cover as an integral part thereof. The top cover may include a single twist-lock receptacle positioned in the center of the top cover. In other embodiments, the top cover may have two or more twist-lock receptacles spaced apart and away from the center of the top cover so as to allow attachment of two or more additional powder containers or other accessories associated with the beverage container as described below in greater detail.

The funnel container may further include a removable bottom plug configured to sealingly fit inside and close off a twist-lock nozzle formed at the bottom opening of the funnel-shaped body. The twist-lock receptacle and the twist-lock nozzle may be configured to fit together so as to facilitate the attachment of the twist-lock nozzle (with the bottom plug within thereof) to the twist-lock receptacle. This arrangement is useful for using the top cover to position the funnel container on a flat surface in a stable manner when filling the container with powder. It is also useful for stacking two or more containers together while the content of each container is securely sealed within each respective container.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF PREFERRED EMBODIMENTS OF THE INVENTION

Figure 1:
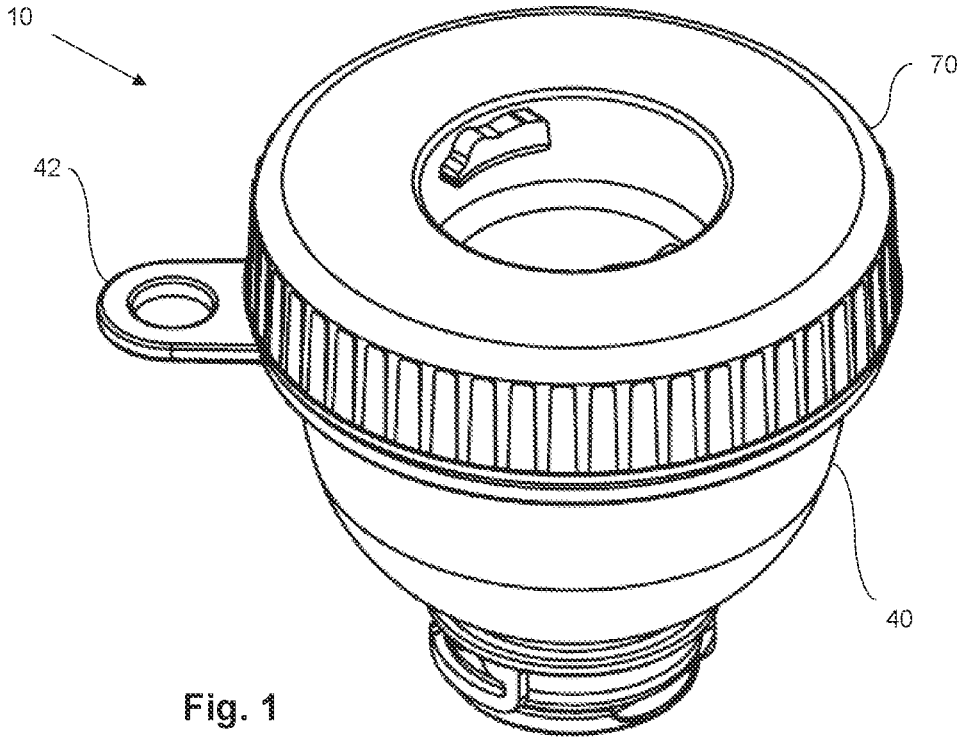
FIG. 1 is a perspective top view of a funnel container of the present invention.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Figure 2:
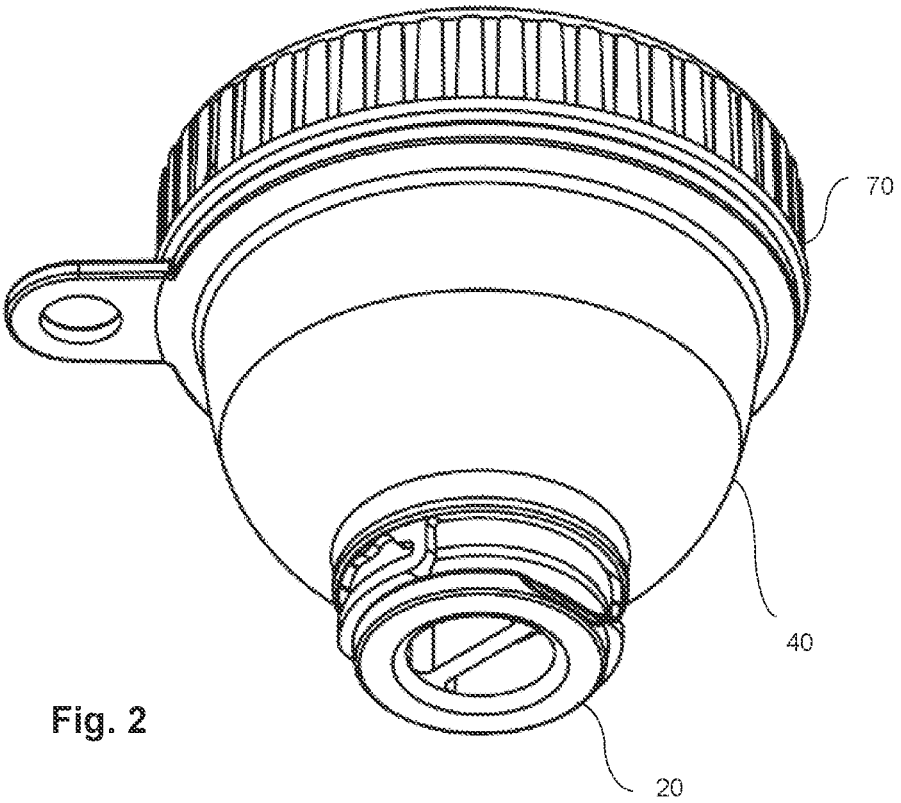
FIG. 2 is a perspective bottom view of a funnel container.

A perspective top view of the funnel container 10 of the present invention is shown in FIG. 1, with FIG. 2 showing a perspective bottom view of the same. In general terms, the funnel container 10 may include a funnel-shaped body 40, a removable bottom plug 20, and a removable top cover 70.

Figure 3:
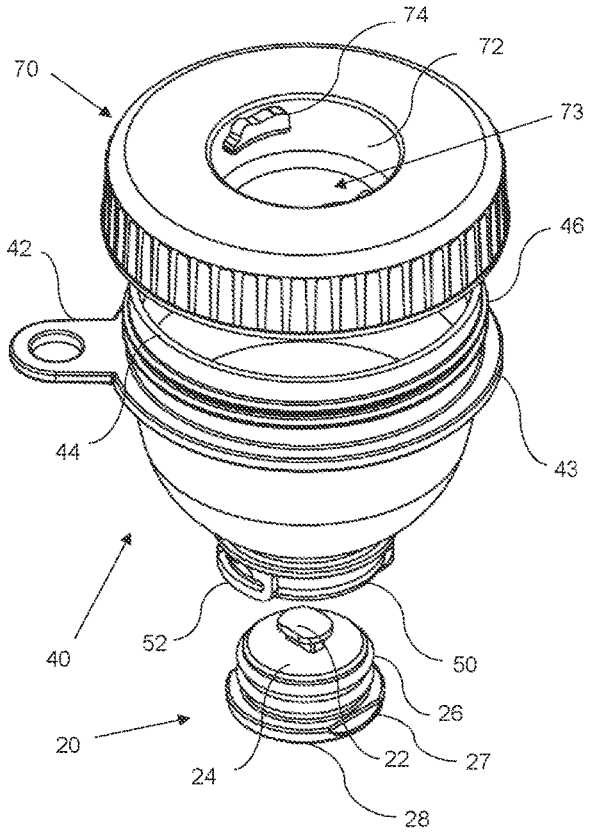
FIG. 3 is a perspective top exploded view of the same.
Figure 4:
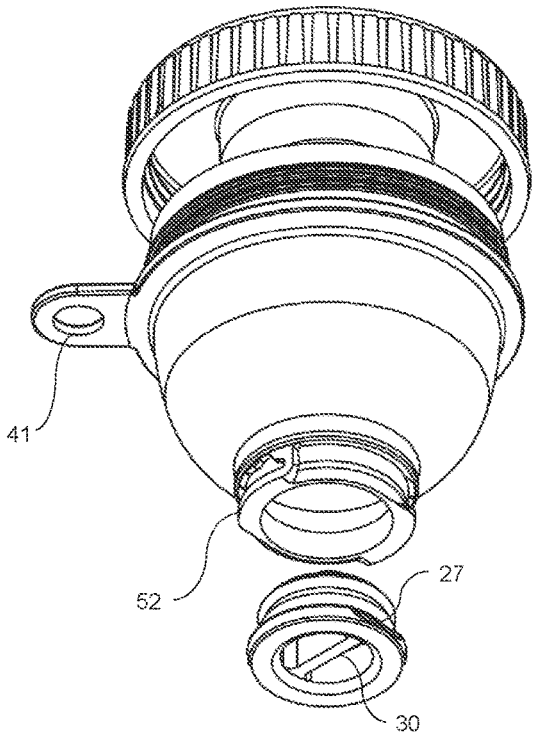
FIG. 4 is a perspective bottom exploded view of the same.
Figure 5:
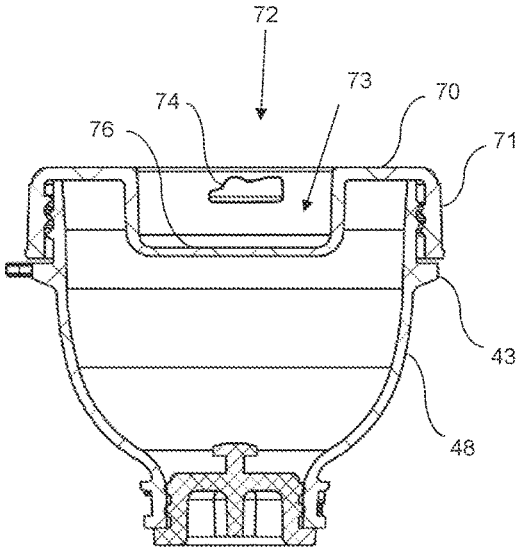
FIG. 5 is a cross-sectional side view of the funnel container.
Figure 6:
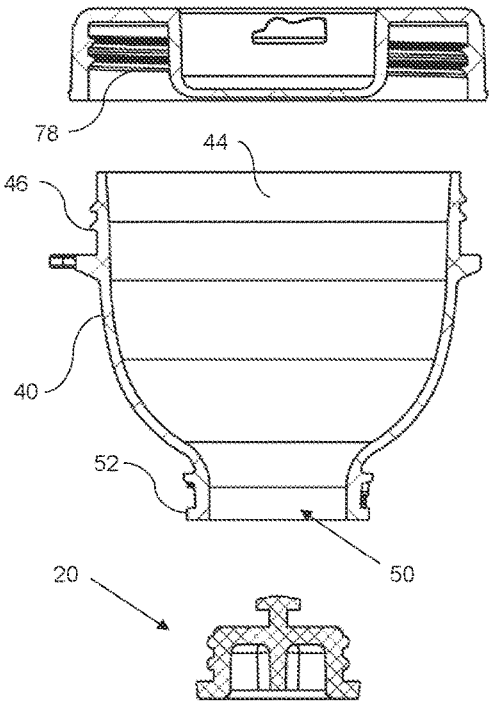
FIG. 6 is a cross-sectional exploded view of the same.

An exploded perspective top view of the funnel container 10 is seen in FIG. 3, with FIG. 4 showing a corresponding perspective bottom view of the same. FIGS. 5 and 6 show cross-sectional views of the funnel container 10 as assembled and with all parts separated in an exploded view. The funnel-shaped body 40 of the funnel container 10 has a shape best seen in FIG. 6, which extends from a wider top opening 44 to a narrow bottom opening 50. The shape of the funnel portion of the funnel-shaped body 40 may be selected to have a tangential line drawn to any point along its curved periphery to be not less than about 30 degrees to the horizontal plane, so as to facilitate easy removal of the content of the funnel container 10 therefrom during use.

The top opening 44 may have an external thread 46 configured to cooperate with an internal thread 78 of the top cover 70 to allow the top cover 70 to removably engage with the top opening 44 of the funnel-shaped body 40. A peripheral lip 43 may be provided to form a stop restraining the extent of the top cover 70 engagement with the top opening 44. Once the top cover 70 is assembled with the funnel-shaped container 40, the top edge of the top opening 44 may abut against the internal surface of the top cover 70, while the outer edge of the side wall 71 may abut the peripheral lip 43—see FIG. 5.

An optional side tab 42 may be formed as a single unit with the funnel-shaped body 40 and extend sideways from the lip 43, as seen in FIG. 3. The side tab 42 may have an opening 41 formed therein and sized to accept a deformable central protrusion 22 of the bottom plug 20 as explained in greater detail below. In other embodiments, the side tab 42 may be omitted altogether, or, in further alternative embodiments, it can be made as a separate ring positioned over and engaged with the corresponding portion of the external surface of the funnel-shaped body 40, as the invention is not limited in this regard.

One or more depressions 73 may be formed in the top cover 70, including a bottom 76, and one or more protrusions 74 extending inward the depression 73 and spaced evenly along the periphery thereof. The depression 73 may, therefore, be shaped as a twist-lock receptacle 72 for accepting a corresponding twist-lock nozzle 52 of the funnel-shaped body 40 or another component or accessory of the beverage bottle, as explained in greater detail below. One or more protrusions 74 may be shaped to cooperate with the corresponding elongated recesses 53 of the twist-lock nozzle 52 as described below. A depth of the depression 73 in the top cover 70 may not exceed the width of the side wall 71 thereof, thereby facilitating using the top cover 70 as a stand for the funnel-shaped body 40 when the twist-lock nozzle 52 is attached to the twist-lock receptacle 72 of the top cover 70, as described in detail below.

In addition to, or instead of, a mechanical seal formed between the side wall 71 of the top cover 70 and the peripheral lip 43 of the funnel-shaped body 40, various other optional sealing arrangements may be provided, such as the inclusion of sealing gaskets, sealing O-rings, and other compressible sealing components, incorporated within the top cover 70 or as part of the external thread 46, as the invention is not limited in this regard.

The exact profile of the funnel-shaped body 40 curvature may be selected as needed based on specific design considerations. In one example shown in the drawings, the shape may be selected to maximize the volume of the powder retained by the funnel container 10 of the invention while facilitating the emptying of the content into the beverage bottle as described below.

A twist-lock nozzle 52 may be formed at the bottom opening 50 of the funnel-shaped body 40—see FIG. 4. The twist-lock nozzle 52 may have an external shape to facilitate the engagement of the funnel container with a corresponding twist-lock receptacle 72 in a manner similar to what is described with regard to the twist-lock connection between the beverage bottle and various accessories thereof in my co-pending patent application Ser. No. 18/399,631 cited above.

Figure 8:
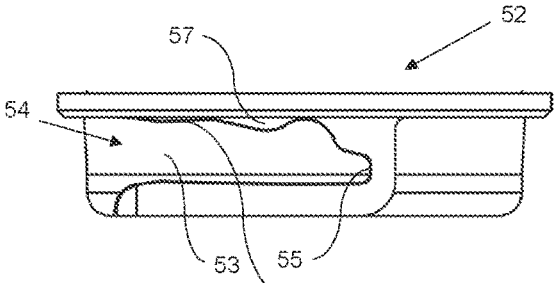
FIG. 8 is a close-up front view of the bottom opening of the funnel container.

As seen in a close-up front view of the twist-lock nozzle 52 in FIG. 8, one or more twist-lock portions may have one or more elongated recesses 53 with an opening 54 at the first end, a stop 55 at the second end, and a ramp 56 with a detent protrusion 57 in between. In the illustrated embodiment, the opening 54, elongated recesses 53, and stop 55 are configured to engage one or more protrusions 74 of the twist-lock receptacle 72 to achieve a releasable locking fit via the twist-and-lock arrangement. In the illustrated embodiments, there are two such sets of features circumferentially located and equidistantly spaced on each of the twist-lock nozzle of the funnel-shaped body 40 and the twist-lock receptacle of the top cover 70. These features may be configured for a releasably locking engagement of the twist-lock nozzle 52 with the twist-lock receptacle 72 when the funneled-shaped body 40 is first pushed into the cavity of the twist-lock receptacle 72 a downward direction and, second, rotated in a clockwise direction. In reverse, the twist-lock nozzle 52 disengages from the twist-lock receptacle 72 when it is first rotated in a counterclockwise direction, and then pulled upward.

As can be appreciated by those skilled in the art, the twist-lock design described above is just one non-limiting example of such releasable attachment. Other designs of various bayonet, friction fit, turn-and-lock, threaded, and similar releasable coupling and connecting attachment mechanisms are within the scope of the term "twist-lock" and are therefore included in the scope of the present invention.

Figure 7:
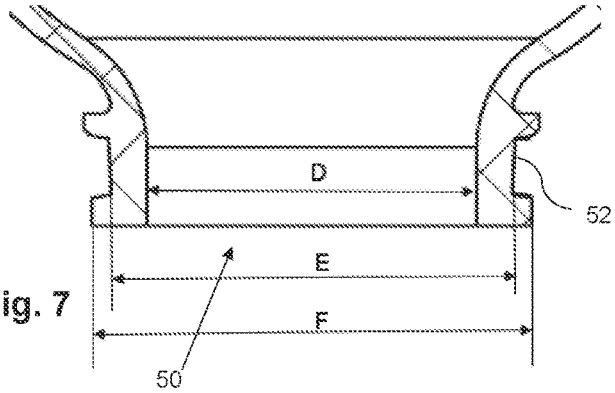
FIG. 7 is a close-up cross-sectional view of the bottom opening of the same.
Figure 9:
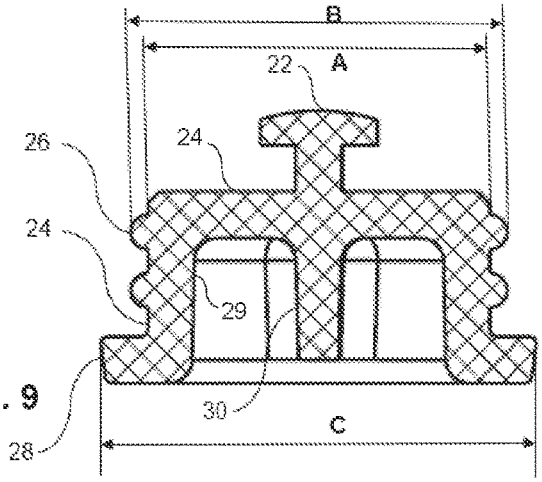
FIG. 9 is a cross-sectional view of the bottom plug of the funnel container.
Figure 10:
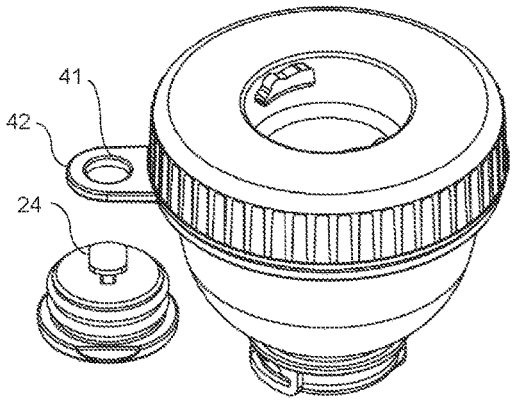
FIG. 10 is a perspective top view of the funnel container and the bottom plug ready for placement in a storage position.
Figure 11:
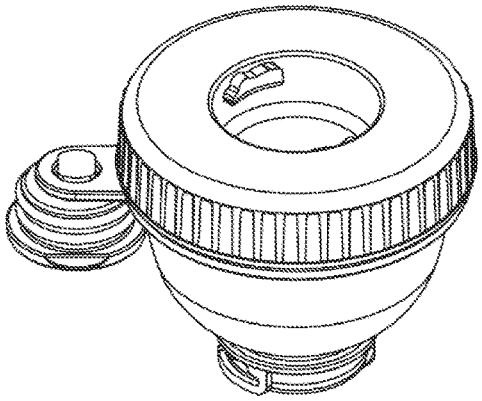
FIG. 11 is a perspective view of the same with the bottom plug attached to the funnel-shaped body in a storage position.
Figure 12:
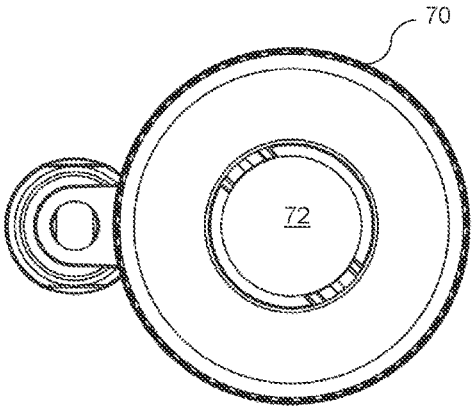
FIG. 12 is a top view of the same as in FIG. 11.
Figure 14:
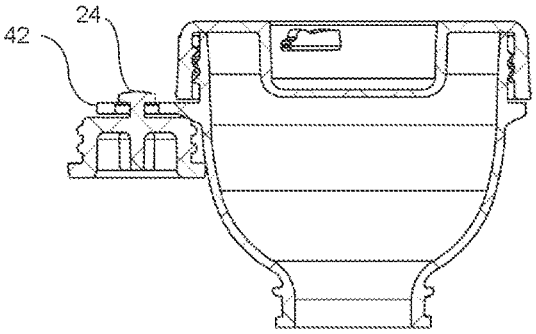
FIG. 14 is a cross-sectional side view of the same as in FIG. 11.
Figure 13:
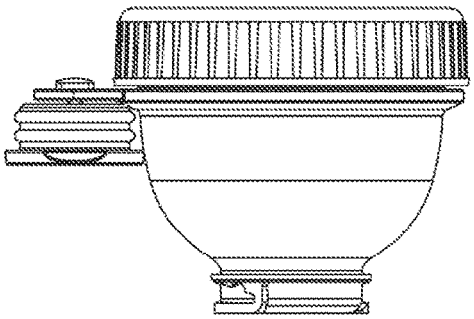
FIG. 13 is a side view of the same as in FIG. 11.
Figure 15:
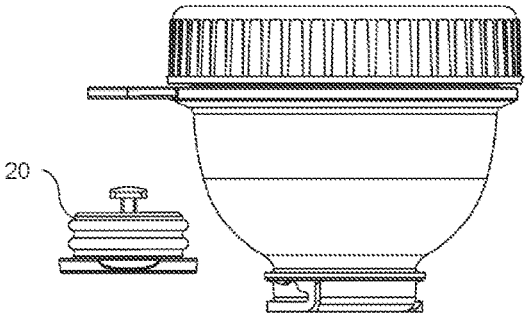
FIG. 15 is a side view of the same as in FIG. 10.

As illustrated in the close-up cross-sectional views in FIGS. 7 and 9, the funnel-shaped body 40 may terminate in a bottom opening 50, which may be shaped in the form of the twist-lock nozzle 52. The inside surface of the bottom opening 50 may be shaped and sized to sealingly accept an elastic plug 20 to be inserted therein. To that end, the internal diameter D of the bottom opening 50 may be made to be smaller than the external diameter B of one or more sealing rings 26, which may be made as part of or as separate components (not shown) of the bottom plug 20. In further embodiments, the seal between the bottom plug 20 and the bottom opening 50 may be achieved by providing the internal diameter D of the bottom opening 50 to be the same or slightly smaller than the external diameter A of the bottom plug 20. In this case, inserting the bottom plug 20 may be done with a small compression thereof to snugly fit inside the bottom opening 50. Other similar sealing arrangements may be provided as the invention is not limited in this regard.

The bottom plug 20 may have a generally cylindrical shape and may be made from a food-grade elastic material. Generally speaking, such materials may be selected to be elastically compressible as well as odorless, tasteless, resistant to bacteria buildup, suitable to be used for food or beverages, reliable at temperature extremes, non-toxic, non-marking, non-allergenic, and capable of being manufactured into a final product using common manufacturing techniques. Common examples of such elastomeric materials include Ethylene Propylene Diene Monomers (EPDM), Fluorocarbons, Neoprene, Nitrile, and Silicones, although the invention is not limited in this regard.

The bottom plug 20 may have a deformable central protrusion 22 extending from the end 24 of the bottom plug 20. The deformable central protrusion 22 may be configured to be capable of removably positioning and retaining the bottom plug 20 at the opening 41 of the side tab 42, as seen in FIG. 10, FIG. 11, and FIGS. 12-15. Placement of the bottom plug 20 in opening 41 may be done as a storage arrangement while emptying the funnel container to avoid losing this small component during use.

As seen in FIG. 9, the bottom plug 20 may have an internal cavity 29 with a septum 30 across thereof, which may be configured to act as a handle and facilitate holding the bottom plug 20 during insertion and removal from the bottom opening 50 of the funnel-shaped body 40. A flange 28 radially extends from one end of the bottom plug 20. The flange 28 may serve as a stopper when inserting the bottom plug 20 into the bottom opening 50. The bottom plug 20 may be flush with the bottom opening when inserted therein, with only the flange 28 of the bottom plug 20 protruding therefrom. The flange 28 may have a thickness from about 1 mm to about 3 mm. A small thickness of the flange 28 is advantageous so as not to cause significant protrusion beyond the edge of the bottom opening. Such protrusion would otherwise necessitate a deeper recess in the corresponding portion of the lid, which, in turn, would limit the usable space available inside the funnel container 10. In embodiments, the flange 28 does not extend beyond the external size of the bottom opening so as not to interfere with the twist-lock engagement mechanism.

One side of the flange 28 may have a cut 27 designed to facilitate lifting and removal of the bottom plug 20 using a fingernail positioned under the flange 28. The size of the bottom plug may be selected to be the least obstructive during the use of the funnel container 10, such as to facilitate the transfer of powder to the water bottle 1000.

Circular or, in other embodiments, non-round flange 28 may be sized (dimension C) to be more than the internal diameter D of the bottom opening 50. In further embodiments, dimension C may be selected not to exceed the external dimension F defined by the twist-lock elements of the twist-lock nozzle 52. Alternatively, dimension C may be selected not to exceed the external diameter E of the bottom opening 50, which defines the elongated recess 53 of the twist-lock nozzle 52. Selecting the depth of the depression 73 to be sufficient to accept the twist-lock nozzle 52 and the flange 28 of the bottom plug 20 positioned inside to sealingly close off the bottom opening 50. This may be done to avoid any interference from the bottom plug 20 during the attachment of the twist-lock nozzle 52 to the twist-lock receptacle 72 of the top cover 40.

Figure 16:
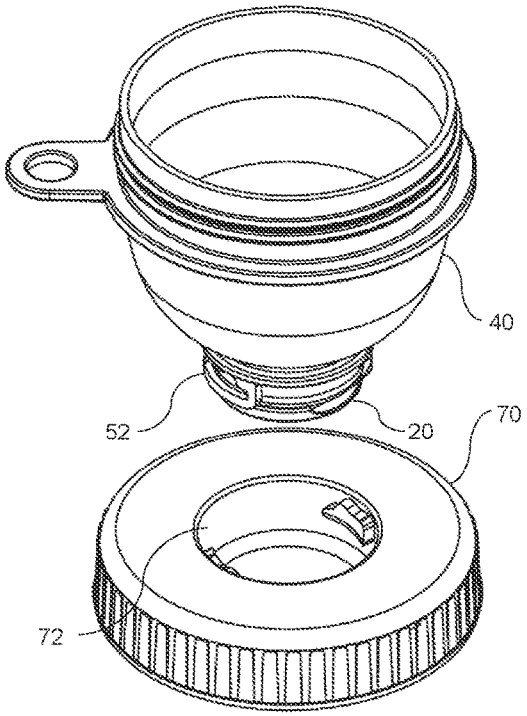
FIG. 16 is a perspective top exploded view of the top cover positioned under the bottom opening of the funnel container.
Figure 17:
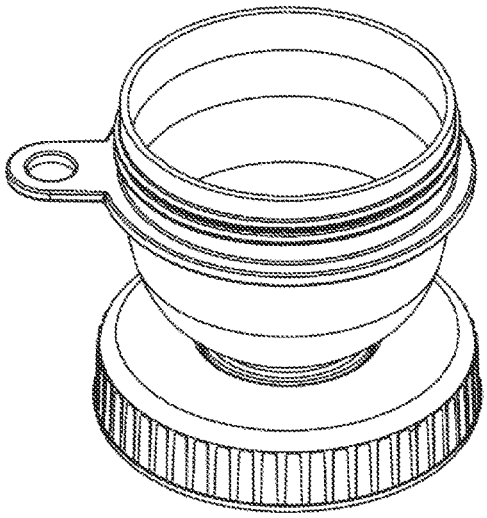
FIG. 17 is a perspective top view of the funnel container assembled over the top cover.

In use, the funnel container 10 may fulfill the first purpose of holding the supplement powder of the user's choice. To do so, the internal volume is made to be sufficient to accept commonly used daily or single doses of conventional supplement powders, as described above. The bottom plug 20 may be positioned to close off the bottom opening 50. The supplement powder may then be deposited into the funnel-shaped body 40, and the top cover 70 may be placed on top to seal off the funnel container 10 until the supplement is required to be mixed with the water or another fluid from the beverage bottle. To make the position of the funnel-shaped body stable, the twist-lock nozzle 52 may be inserted into the top cover 70. The top cover 70, in this case, may serve as a wide base or a stand for placing the funnel-shaped body 40 on a flat surface, as illustrated in FIGS. 16 and 17.

Figure 18:
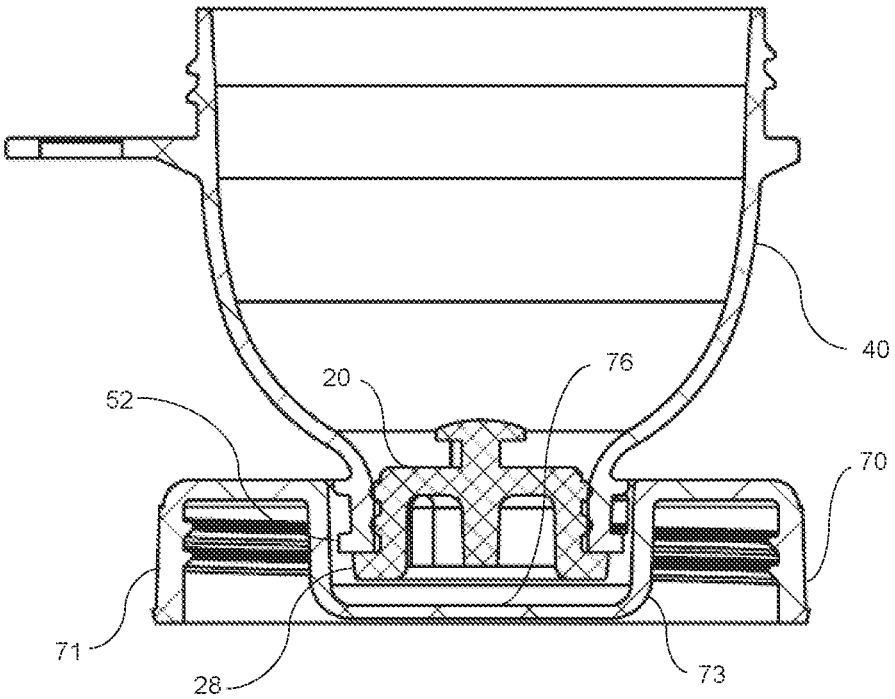
FIG. 18 is a cross-sectional side view of the same as in FIG. 17.

As seen in FIG. 18, the space between the bottom opening 50 and the bottom 76 of the depression 72 is sufficient to accept the bottom plug 20 positioned inside the bottom opening 50 as well as the flange 28 protruding downward therefrom. At the same time, the depression 72 does not extend beyond the depth of the sidewall 71 to ensure that there is full contact of the edge of the sidewall 71 with the supporting flat surface.

Figure 19:
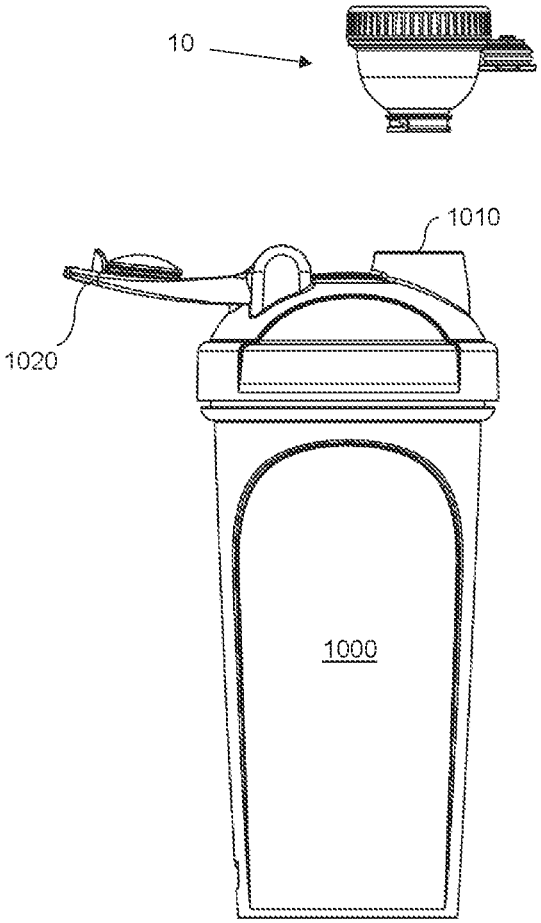
FIG. 19 is an exploded side view of the funnel container and a beverage bottle.
Figure 20:
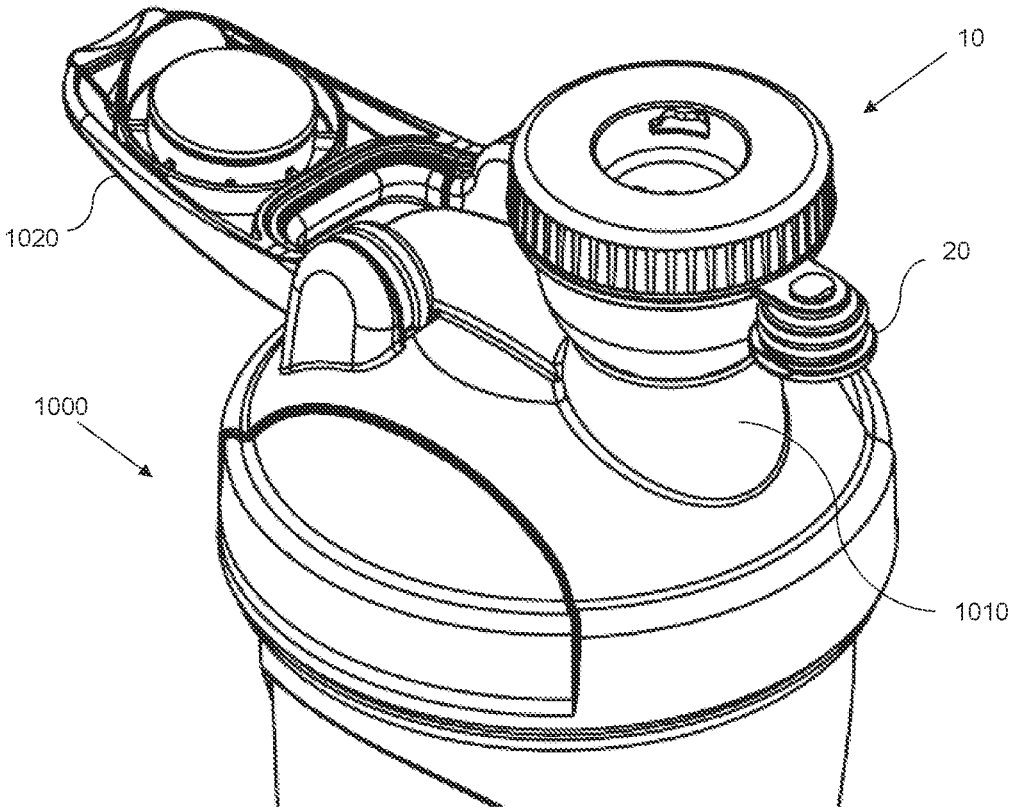
FIG. 20 is a close-up perspective top view of the funnel container positioned in the mouth of the beverage bottle.
Figure 21:
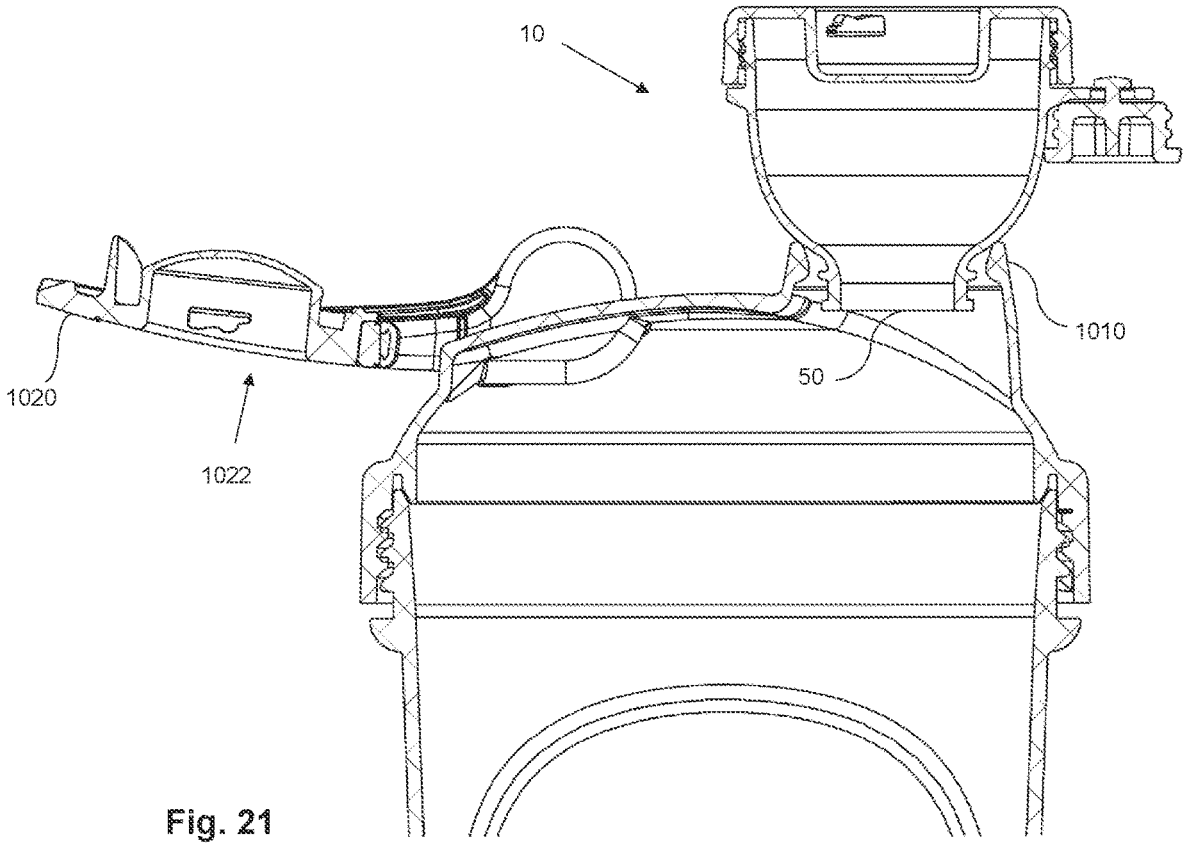
FIG. 21 is a cross-sectional view of the same as in FIG. 20.

To deposit the supplement powder into the water or another beverage contained in the beverage bottle 1000, the funnel container 10 may be flipped upside down, the bottom plug 20 may be removed (and temporarily attached to the side tab 42), and the powder may be shifted from the funnel container 10 as directed by the funnel-shaped body 40 through the bottom opening 50 into the mouth 1010 of the beverage bottle 1000—see FIGS. 19-21. The flip cap 1020 of the beverage bottle 1000 may have a twist-lock receptacle 1022 as part thereof (see FIG. 21), which is sized to be the same as the twist-lock receptacle 72 of the top cover 70. In this case, when the flip cap 1022 is closed, the funnel container 10 may be attached thereto for easy transport together with the beverage bottle 1000.

The twist-lock feature of receptacle 72 in the top cover 70 and the twist-lock nozzle 52 of the bottom opening 50 may be made to have the same size as other accessories of the beverage bottle 1000, thereby forming a universal adapter described in my other patent applications cited above.

Figure 24:
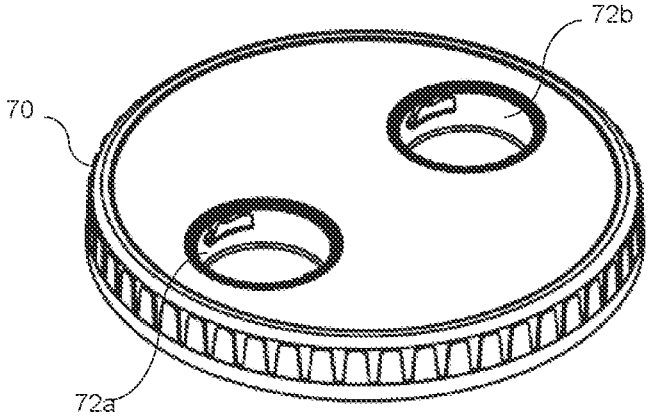
FIG. 24 is a perspective top view of the top cover containing two twist-lock receptacles.
Figure 25:
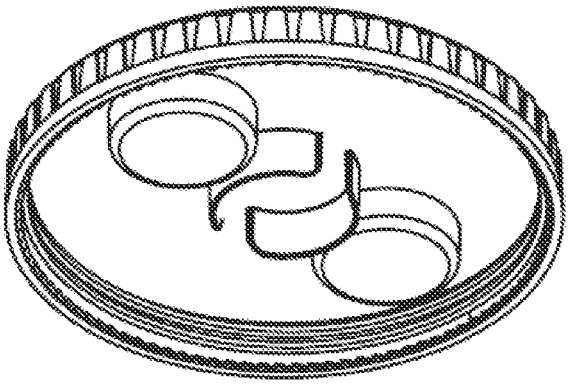
FIG. 25 is a perspective bottom view of the same as in FIG. 24.

FIGS. 24 and 25 show an alternative version of the top cover 70, in which a first twist-lock receptacle 72*a* and a second twist-lock receptacle 72*b* are positioned across the center of the top cover 70 and may be spaced apart equidistantly therefrom. The second twist-lock receptacle 72*b* may be identical to the first twist-lock receptacle 72*a*. In some embodiments, the distance between the centers of the twist-lock receptacles 72 may be equal to half of the diameter of the top cover 70. In other embodiments, that distance may exceed half of the diameter to accommodate larger accessories to be positioned side-by-side on the top cover 70.

Figure 22:
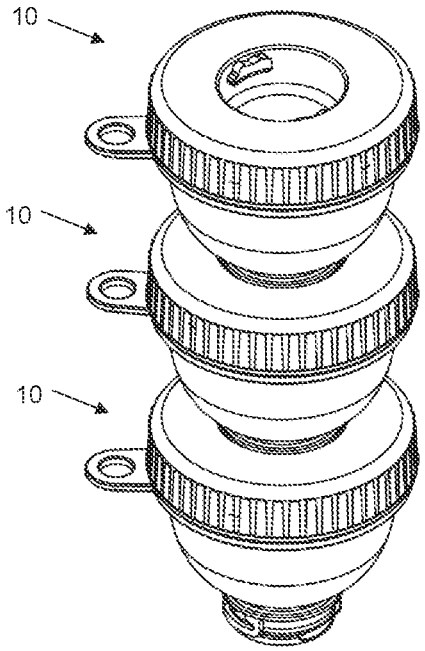
FIG. 22 is a perspective top view of a stack of three funnel containers of the present invention.
Figure 23:
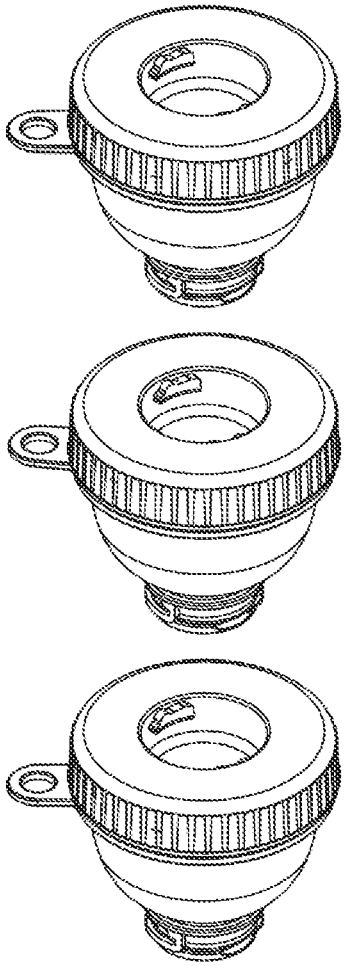
FIG. 23 is a perspective exploded view of the same as in FIG. 22.
Figure 26:
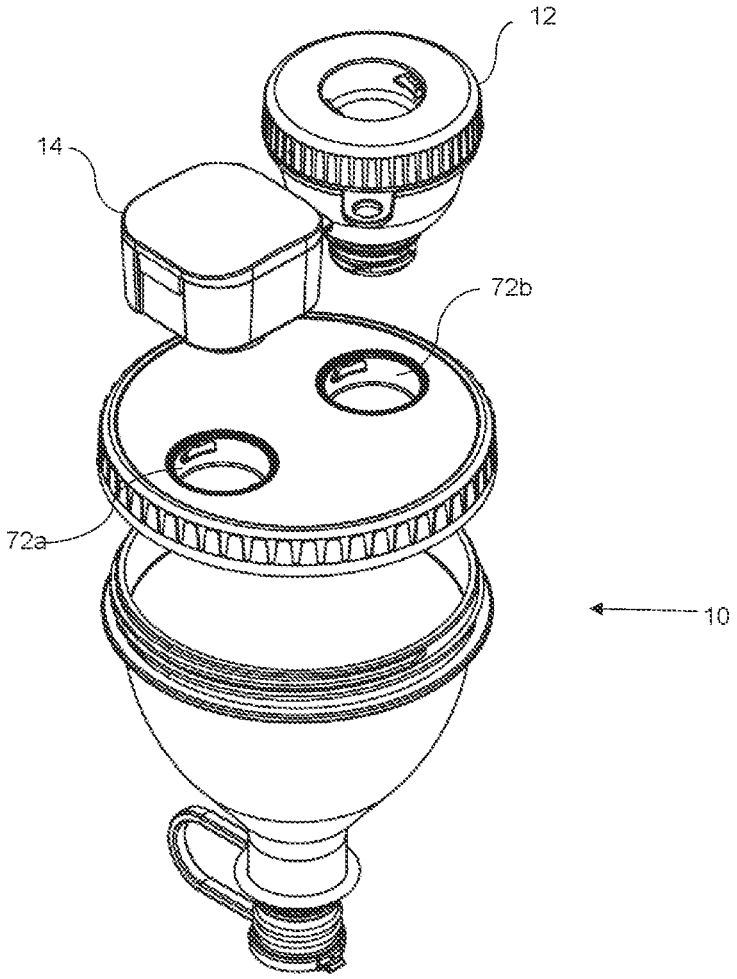
FIG. 26 is a perspective top exploded view of multiple accessories assembled on the top cover of the funnel container.
Figure 27:
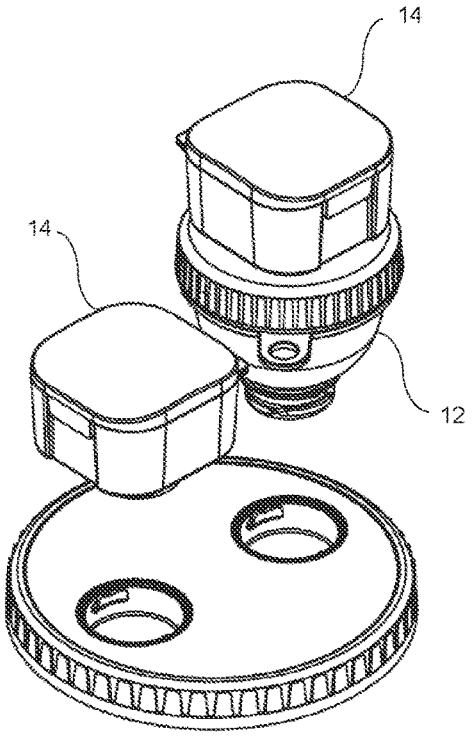
FIG. 27 is a perspective top exploded view of further multiple accessories assembled on the top cover of the funnel container.
Figure 28:
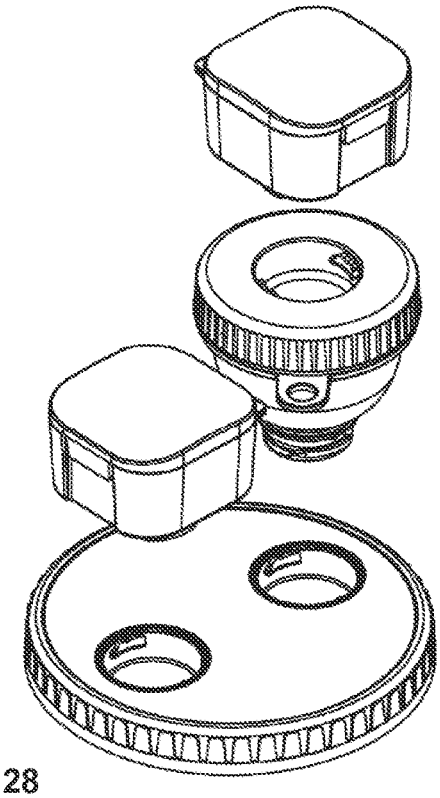
FIG. 28 is yet another perspective top exploded view of various multiple accessories assembled on the top cover of the funnel container.
Figure 29:
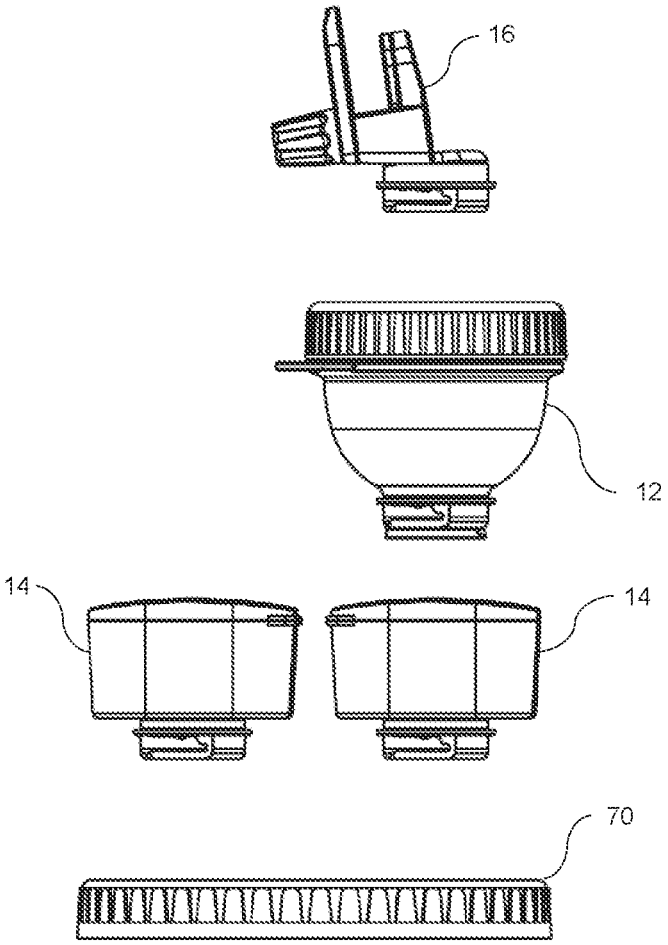
FIG. 29 is an exploded side view of further accessories to be assembled on the top cover of the funnel container.
Figure 30:
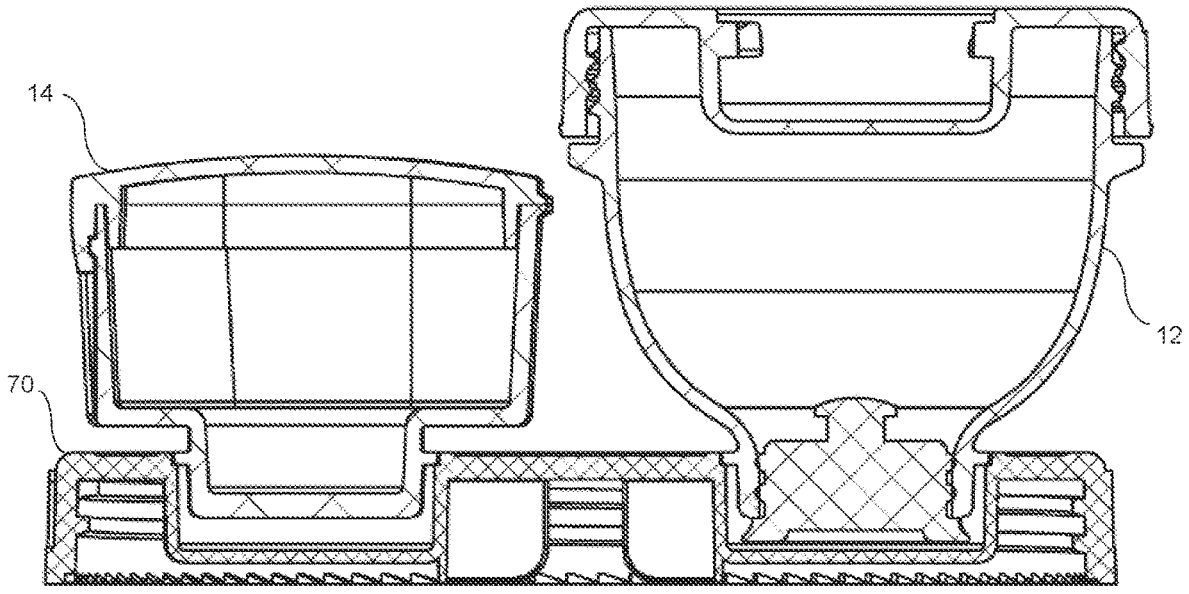
FIG. 30 is a cross-sectional view of two accessories assembled on the top cover of the funnel container.
Figure 31:
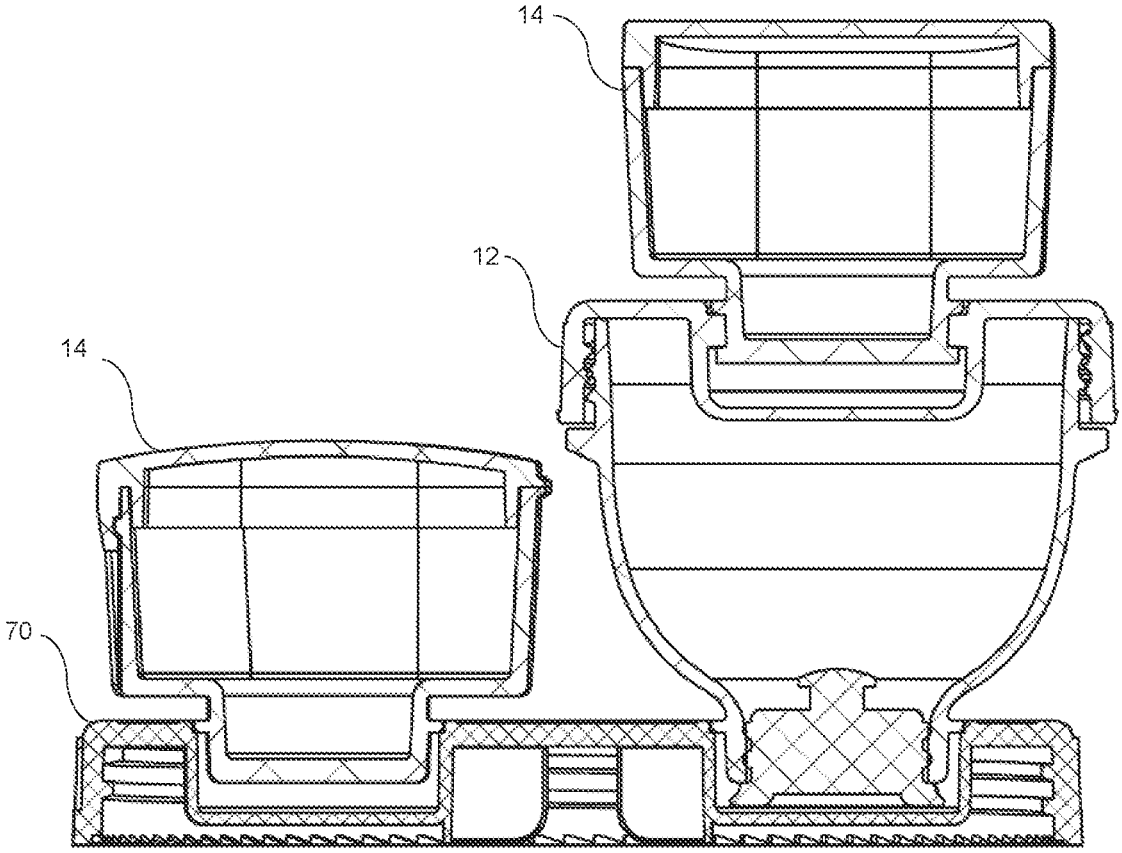
FIG. 31 is a cross-sectional view of three accessories assembled on the top cover of the funnel container.

Various combinations of accessories may be stacked together, assembled side-by-side, or stacked in a side-by-side arrangement as follows:

a. stack up two or more funnel containers 10 together in a vertical arrangement as seen in FIGS. 22 and 23;
b. attach more than one funnel container 10 or 12 of various sizes, filled with one or more individual powders as arranged side-by-side, as seen in FIG. 26, and
c. mix and match stack-up arrangements by including other accessories, such as a tablet holder 14 or a phone stand and holder accessory 16, as seen in FIGS. 27-31.

Further details and examples of these other interchangeable accessories that may be equipped with the same twist-lock connector are described in my co-pending US applications cited above.

In further embodiments, the funnel container 10 may come in several sizes. One example seen in FIG. 26 shows a top cover 70 from a larger funnel container 10 having two twist-lock receptacles 72 spaced apart from each other along the top cover 70.

In further embodiments, a kit comprising a funnel receptacle 10 and at least one of a smaller funnel receptacle 12, a pill box 14, or a phone stand and holder accessory 16 may be provided. All of these additional accessories may include a twist-lock nozzle identical to the twist-lock nozzle 52 of the funnel-shaped body 40, so as to facilitate removable attachment thereof to the top cover 70 of the funnel container 10.

In a further example, each twist-lock receptacle 72*a* and 72*b* may accept one of a smaller funnel container 12, a pill box accessory 14, or other accessories of the beverage bottle 1000. This arrangement further allows placement of two or more smaller funnel containers 12 on top of a single top cover 70 designed to fit over a larger funnel container 10. This may be advantageous when the volume of powder required to be stored for a day of use exceeds the internal volume of a smaller funnel container 12.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB. CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A funnel container for storing powdered supplements comprising:

a funnel-shaped body extending from a top opening to a bottom opening, wherein the bottom opening is smaller than the top opening, a removable top cover configured to sealingly close off the top opening, the top cover comprises a first twist-lock receptacle and a second twist-lock receptacle spaced apart from the first twist-lock receptacle, the second twist-lock receptacle being identical to the first twist-lock receptacle, and a removable bottom plug configured to sealingly fit inside and close off a twist-lock nozzle formed at the bottom opening of the funnel-shaped body, wherein the first twist-lock receptacle of the top cover is further configured to removably accept the twist-lock nozzle of the bottom opening with the bottom plug positioned therein.

2. The funnel container, as in claim 1, wherein the first twist-lock receptacle is formed within the top cover as an integral part thereof.

3. The funnel container, as in claim 1, wherein the top opening, the bottom opening, the top cover and the bottom plug are circular in shape, and wherein the bottom opening has a smaller diameter than the top opening.

4. The funnel container, as in claim 1, wherein the first twist-lock receptacle is formed as a depression in the top cover extending along a side wall thereof, a depth of the depression in the top cover is not exceeding a width of the side wall thereof, thereby facilitating using the top cover as a stand for the funnel-shaped body when the twist-lock nozzle is attached to the twist-lock receptacle of the top cover.

5. The funnel container, as in claim 4, wherein the first twist-lock receptacle further contains one or more protrusions extending inward from the depression in the top cover and spaced evenly along the periphery thereof.

6. The funnel container, as in claim 4, wherein the twist-lock nozzle comprises one or more elongated recesses corresponding to the one or more protrusions of the twist-lock receptacle and configured to releasably engage therewith to removably attach the funnel-shaped body to the top cover of the funnel container.

7. The funnel container, as in claim 1, wherein the bottom plug is made from a food-grade elastomeric material.

8. The funnel container, as in claim 7, wherein the bottom plug is larger than the bottom opening, thereby insertion of the bottom plug into the bottom opening causes compression of the bottom plug to facilitate retention thereof at the bottom opening and sealing of the bottom opening.

9. The funnel container, as in claim 8, wherein the bottom plug has a generally cylindrical shape with at least one ring extending radially therefrom and sized to be compressed upon insertion of the bottom plug into the bottom opening of the funnel-shaped body.

10. The funnel container, as in claim 8, wherein the bottom plug further comprises a flange on one end thereof extending radially to form a stopper when inserting the bottom plug into the bottom opening of the funnel-shaped body.

11. The funnel container, as in claim 10, wherein the bottom plug is flush with the bottom opening when inserted therein with only the flange of the bottom plug protruding therefrom.

12. The funnel container, as in claim 8, wherein the bottom plug further comprises a septum across an internal cavity thereof facilitating removal of the bottom plug from the bottom opening of the funnel-shaped body.

13. The funnel container, as in claim 1, wherein the first twist-lock receptacle and the second twist-lock receptacle are positioned across a center of the top cover and are equidistant therefrom.

14. The funnel container, as in claim 13, wherein the first twist-lock receptacle is spaced away from the second twist-lock receptacle by at least half a diameter of the top cover.

15. A kit comprising the funnel receptacle of claim 1 and at least one of a smaller funnel receptacle, a pill box, or a phone stand and holder accessory, wherein the at least one of a smaller funnel receptacle, a pill box, or a phone stand and holder accessory comprising a twist-lock nozzle identical to the twist-lock nozzle of the funnel-shaped body, so as to facilitate removable attachment to the top cover of the funnel container.

16. A beverage bottle combination with a funnel container, the beverage bottle equipped with a lid configured to removably accept the funnel container for storing powdered supplements, wherein the lid comprises a first twist-lock receptacle, and wherein the funnel container comprises:

a funnel-shaped body extending from a top opening to a bottom opening, wherein the bottom opening is smaller than the top opening, a removable top cover configured to sealingly close off the top opening, the top cover comprises the first twist-lock receptacle identical to the first twist-lock receptacle of the lid, and a removable bottom plug configured to sealingly fit inside and close off a twist-lock nozzle formed at the bottom opening of the funnel-shaped body, wherein the first twist-lock receptacle of the top cover and the first twist-lock receptacle of the lid are further configured to removably accept the twist-lock nozzle of the bottom opening with the bottom plug positioned therein.

* * * * *